US012042899B2

(12) United States Patent
Zuniga et al.

(10) Patent No.: US 12,042,899 B2
(45) Date of Patent: Jul. 23, 2024

(54) POLISHING HEAD WITH MEMBRANE POSITION CONTROL

(71) Applicant: Applied Materials, Inc., Santa Clara, CA (US)

(72) Inventors: Steven M. Zuniga, Soquel, CA (US); Jay Gurusamy, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 18/132,158

(22) Filed: Apr. 7, 2023

(65) Prior Publication Data

US 2023/0241744 A1 Aug. 3, 2023

Related U.S. Application Data

(63) Continuation of application No. 16/706,489, filed on Dec. 6, 2019, now Pat. No. 11,623,320.

(60) Provisional application No. 62/890,024, filed on Aug. 21, 2019.

(51) Int. Cl.
*B24B 37/005* (2012.01)
*B24B 37/32* (2012.01)

(52) U.S. Cl.
CPC ..... *B24B 37/005* (2013.01); *B24B 37/32* (2013.01)

(58) Field of Classification Search
CPC ..... B24B 37/005; B24B 37/32; B24B 37/27; B24B 37/30; B24B 9/10; B24B 9/12; B24B 9/16; B24B 37/042; B24B 37/205
USPC ..... 451/5, 6, 9, 10, 41, 287, 288, 398
See application file for complete search history.

(56) References Cited

U.S. PATENT DOCUMENTS

| | | | | |
|---|---|---|---|---|
| 5,681,215 | A | 10/1997 | Sherwood et al. | |
| 5,865,666 | A | 2/1999 | Nagahara | |
| 6,146,259 | A | 11/2000 | Zuniga et al. | |
| 6,517,415 | B2 | 2/2003 | Govzman et al. | |
| 7,374,644 | B2 * | 5/2008 | Butterfield | H01L 21/32125 204/286.1 |
| 9,403,255 | B2 | 8/2016 | Fukushima et al. | |
| 10,946,496 | B2 | 3/2021 | Yavelberg | |
| 2002/0039879 | A1 | 4/2002 | Zuniga et al. | |
| 2002/0049024 | A1 | 4/2002 | Zuniga et al. | |
| 2004/0121704 | A1 | 6/2004 | Sakurai et al. | |
| 2007/0082589 | A1 * | 4/2007 | Zuniga | B24B 37/30 451/288 |

(Continued)

FOREIGN PATENT DOCUMENTS

| | | |
|---|---|---|
| CN | 106463381 | 2/2017 |
| CN | 108604543 | 9/2018 |

(Continued)

OTHER PUBLICATIONS

International Search Report and Written Opinion in International Appln. No. PCT/US2020/047252, dated Nov. 17, 2020, 11 pages.

(Continued)

*Primary Examiner* — Laura C Guidotti
*Assistant Examiner* — Caleb Andrew Holizna
(74) *Attorney, Agent, or Firm* — Fish & Richardson P.C.

(57) ABSTRACT

A carrier head for chemical mechanical polishing includes a housing for attachment to a drive shaft, a membrane assembly beneath the housing with a space between the housing and the membrane assembly defining a pressurizable chamber, and a sensor in the housing configured to measure a distance from the sensor to the membrane assembly.

12 Claims, 4 Drawing Sheets

(56) References Cited

U.S. PATENT DOCUMENTS

| | | | |
|---|---|---|---|
| 2009/0191797 | A1 | 7/2009 | Nabeya et al. |
| 2012/0264354 | A1* | 10/2012 | Liao ..... B24B 37/005 451/6 |
| 2014/0020829 | A1 | 1/2014 | Chen et al. |
| 2014/0342640 | A1 | 11/2014 | Fukushima et al. |
| 2015/0111314 | A1 | 4/2015 | Iizumi et al. |
| 2018/0056476 | A1 | 3/2018 | Zhang et al. |

FOREIGN PATENT DOCUMENTS

| | | |
|---|---|---|
| CN | 109715342 | 5/2019 |
| JP | 2002-264005 | 9/2002 |
| JP | 2007-019584 | 1/2007 |
| JP | 2013-506297 | 2/2013 |
| JP | 2014-223684 | 12/2014 |
| KR | 10-2003-0031354 | 4/2003 |
| KR | 10-2011-0080937 | 7/2011 |
| TW | 200942362 | 10/2009 |

OTHER PUBLICATIONS

Office Action in Japanese Appln. No. 2022-509021, dated Feb. 14, 2023, 9 pages (with English translation).
Office Action in Chinese Appln. No. 202080064418.2, dated Jun. 27, 2023, 14 pages (with English translation).
Office Action in Korean Appln. No. 10-2022-7008766, dated Dec. 12, 2023, 13 pages (with English summary).
Office Action in Taiwanese Appln. No. 109128193, dated Feb. 29, 2024, 12 pages (with English summary and search report).
Notice of Allowance in Chinese Appln. No. 202080064418.2, dated Apr. 18, 2024, 8 pages (with English translation).
Notice of Allowance in Korean Appln. No. 10-2022-7008766, dated Jun. 11, 2024, 6 pages (with English translation).

* cited by examiner

POLISHING HEAD WITH MEMBRANE POSITION CONTROL

CROSS-REFERENCE TO RELATED APPLICATIONS

This application is a continuation of U.S. patent application Ser. No. 16/706,489, filed Dec. 6, 2019, which claims priority to U.S. Provisional Patent Application 62/890,024, filed Aug. 21, 2019, the disclosure of which is incorporated by reference.

TECHNICAL FIELD

This invention relates to a carrier head for use in chemical mechanical polishing (CMP).

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate. As another example, a dielectric layer can be deposited over a patterned conductive layer, and then planarized to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing slurry with abrasive particles is typically supplied to the surface of the polishing pad.

SUMMARY

In one aspect, a carrier head for chemical mechanical polishing includes a housing for attachment to a drive shaft, a membrane assembly beneath the housing with a space between the housing and the membrane assembly defining a pressurizable chamber, and a sensor in the housing configured to measure a distance from the sensor to the membrane assembly.

In another aspect, a chemical mechanical polishing system includes a platen to support a polishing pad, a carrier head, and a controller. The carrier head includes a housing for attachment to a drive shaft, a membrane assembly beneath the housing, a space between the housing and the membrane assembly that defines a pressurizable chamber, and a sensor in the housing configured to measure a distance from the sensor to the membrane assembly. The controller is configured to receive measurements from the sensor and configured to control a pressure source to pressurize the pressurizable chamber based on the measurements. Advantages of the foregoing may include, but are not limited to, the following. A sensor can detect changes in the distance between the sensor and a target on the membrane assembly, e.g., due to wear of a retaining ring. A controller can cause the pressure in a chamber above the membrane assembly to decrease to maintain a consistent load on a substrate across multiple polishing operations, thus improving wafer-to-wafer uniformity. The details of one or more implementations are set forth in the accompanying drawings and the description below. Other aspects, features, and advantages will be apparent from the description and drawings, and from the claims.

DETAILED DESCRIPTION

In some polishing systems, a membrane in a carrier head is used to apply pressure on a substrate during polishing. For example, a chamber above a membrane assembly can be pressurized to urge the membrane against the substrate. However, as a retaining ring of the carrier head wears, the load on the substrate can increase, resulting in wafer-to-wafer non-uniformity. For example, as the retaining ring wears, the deflection of a flexure connecting the membrane assembly to the carrier head can increase, resulting in greater down force on the membrane assembly, which in turn can increase the loading on the substrate. A potential solution is to adjust the chamber pressure applied to the membrane assembly to compensate for any change in the down force from the flexure so that the total loading on the substrate stays relatively constant.

An additional problem, however, is that the actual downforce from the flexure on the membrane assembly is not amenable to direct measurement. However, a distance from a sensor on the carrier head to the membrane assembly can be measured. As the measured distance decreases, the chamber pressure can be decreased, reducing the change in loading on the substrate. This can reduce wafer-to-wafer non-uniformity caused by retaining ring wear. The retaining ring could then have a longer lifespan before requiring replacement.

Figure 1A:
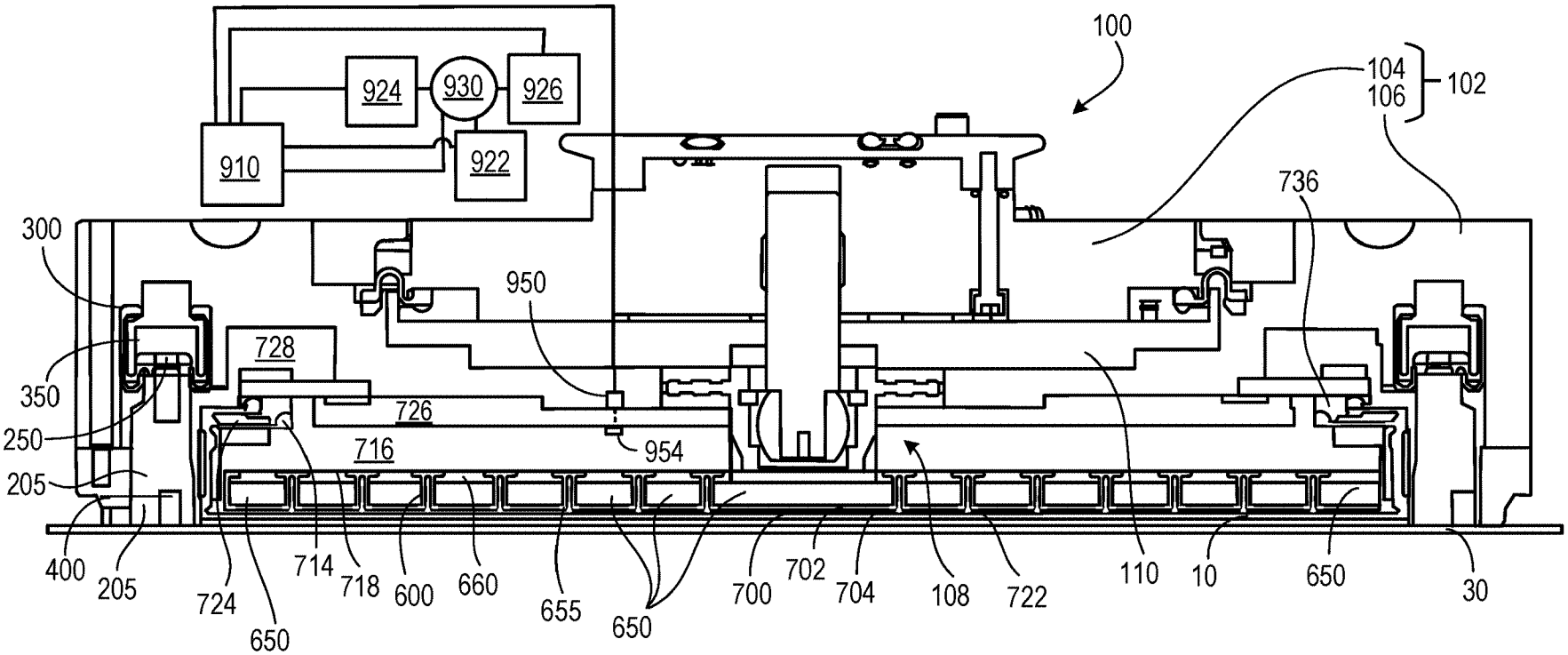
FIG. 1A is a schematic cross-sectional view of a carrier head.
Figure 1B:
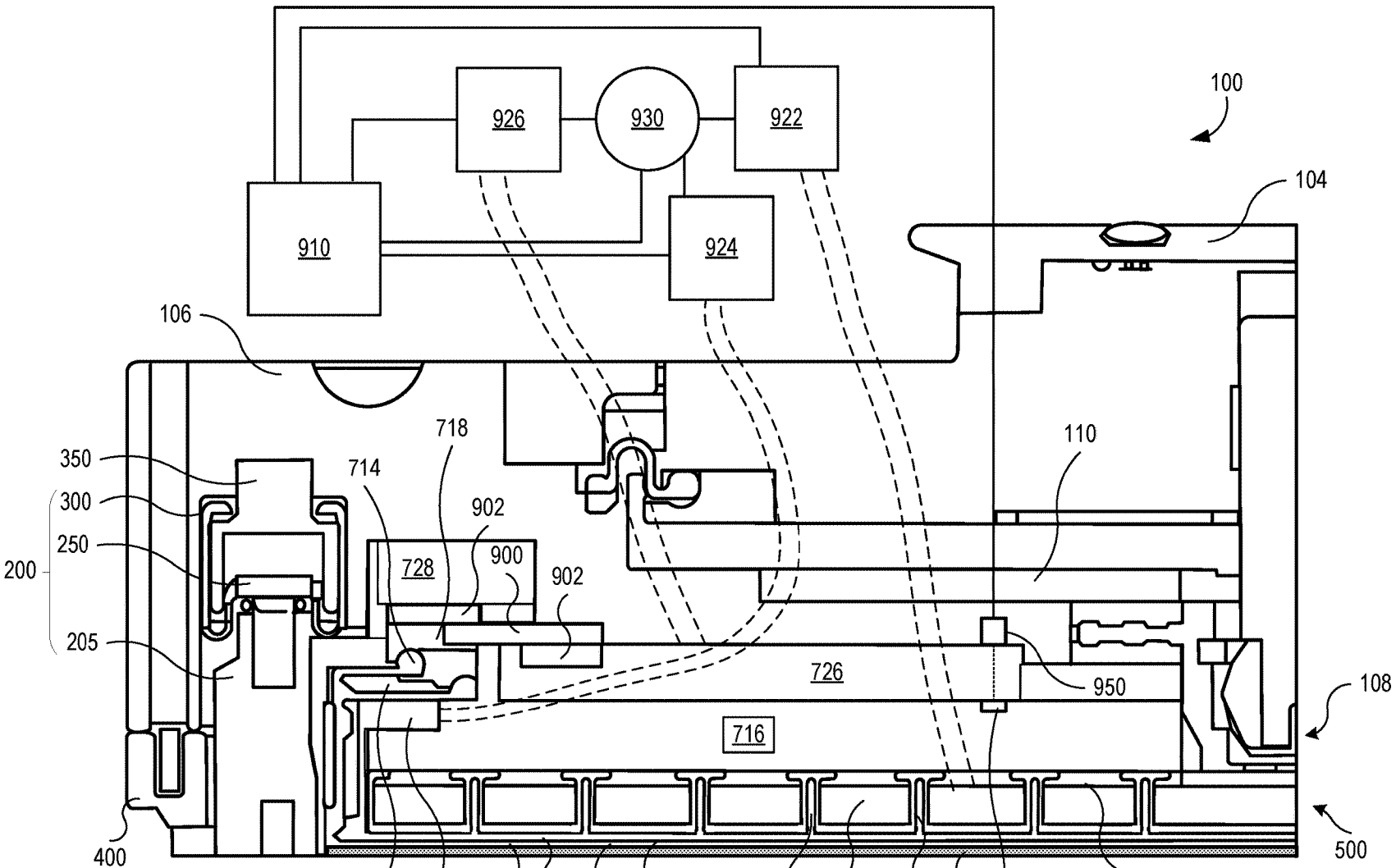
FIG. 1B is a schematic cross-sectional view of a portion of the carrier head in FIG. 1A.
Figure 1C:
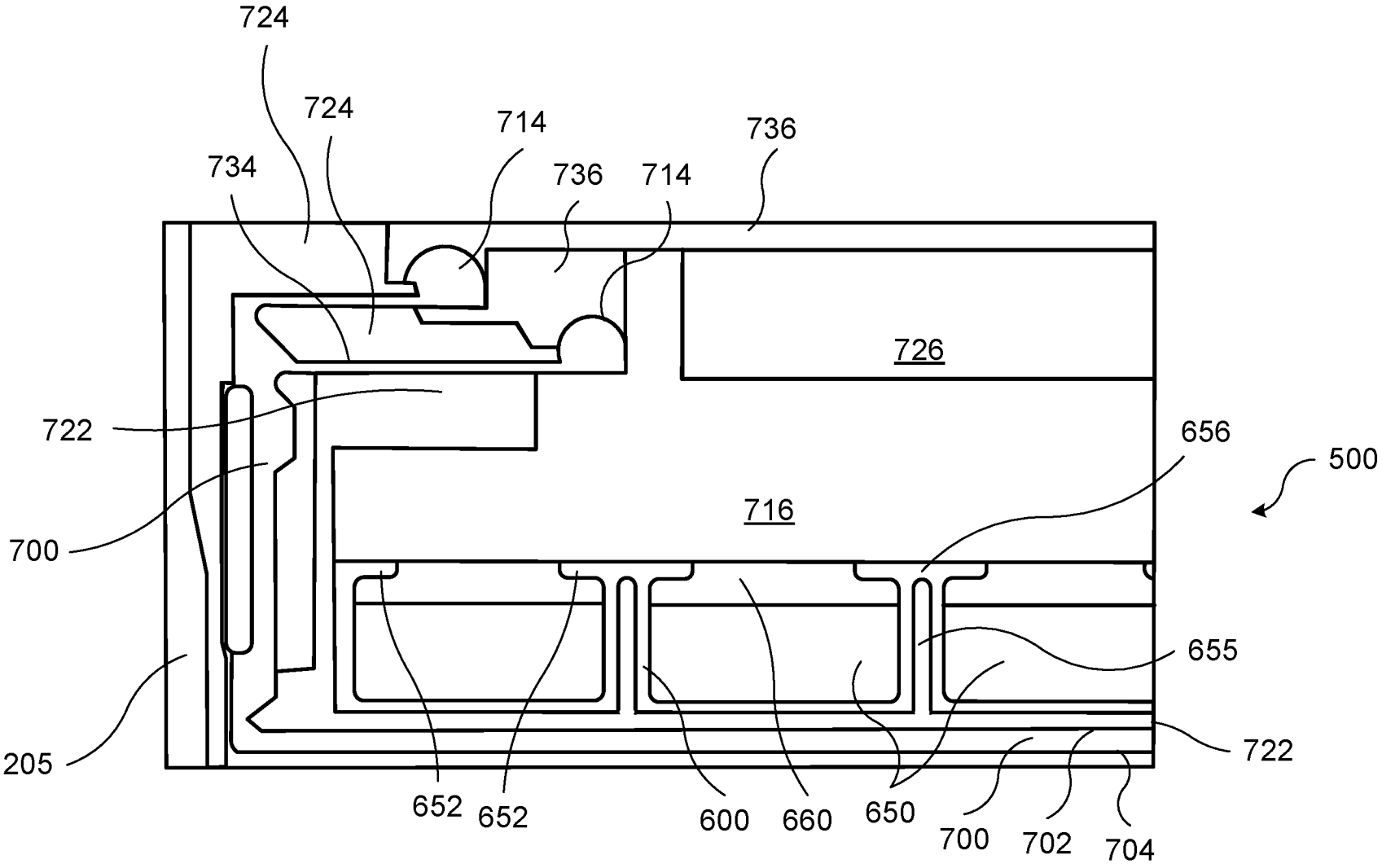
FIG. 1C is a schematic cross-sectional view of a portion of the carrier head in FIG. 1A.

Referring to FIGS. 1A-1C, a substrate 10 can be polished by a chemical mechanical polishing (CMP) apparatus that has a carrier head 100. The carrier head 100 includes a housing 102 with an upper carrier body 104 and lower carrier body 106, a gimbal mechanism 108 (which may be considered part of the lower carrier body 106), a loading chamber 110, a retaining ring assembly (discussed below) connected to the housing 102 (e.g., connected to the upper carrier body 104 and/or the lower carrier body 106), an outer ring 400 connected to the housing 102 (e.g., connected to the upper carrier body 104 and/or the lower carrier body 106), and a membrane assembly 500. In some implementations, the upper carrier body 104 and the lower carrier body 106 are replaced by a single unitary body. In some implementations, there is only a single ring; either the retaining ring 205 or the outer ring 400 is absent.

The upper carrier body 104 can be secured to a rotatable drive shaft to rotate the entire carrier head 100. The upper carrier body 104 can generally be circular in shape. There may be passages extending through the upper carrier body 104 for pneumatic control of the carrier head 100. The lower carrier body 106 is located beneath the upper carrier body 104, and vertically movable relative to the upper carrier body 104. The loading chamber 110 is located between the upper carrier body 104 and the lower carrier body 106 to apply a load, i.e., a downward pressure or weight, to the lower carrier body 106. The vertical position of the lower carrier body 106 relative to a polishing pad is also controlled by the loading chamber 110. In some embodiments, the vertical position of the lower carrier body 106 relative to the polishing pad is controlled by an actuator.

The gimbal mechanism 108 permits the lower carrier body 106 to gimbal and vertically move relative to the upper carrier body 104 while preventing lateral motion of the lower carrier body 106 relative to the upper carrier body 104. However, in some implementations, there is no gimbal.

A substrate 10 can be held by a retaining ring 205. A retaining ring assembly 200 can include the retaining ring 205 and a flexible membrane 300 shaped to provide an annular chamber 350 to control pressure on the retaining ring 205. The retaining ring 205 is positioned beneath the flexible membrane 300 and can be secured to the flexible membrane 300, e.g., by a clamp 250. The load on the retaining ring 205 provides a load to the polishing pad 30. Independent loading on the retaining ring 205 can allow consistent loading on the pad as the ring wears.

While the retaining ring 205 can be configured to retain a substrate 10 and provide active edge process control, the outer ring 400 can provide positioning or referencing of the carrier head to the surface of the polishing pad.

Each chamber in the carrier head can be fluidly coupled by passages through the upper carrier body 104 and the lower carrier body 106 to an associated pressure source (e.g., a pressure source 922), such as a pump or pressure or vacuum line. There can be one or more passages for the annular chamber 350 of the flexible membrane 300, for the loading chamber 110, for the lower pressurizable chamber 722, and for each of the individually pressurizable inner chambers 650. One or more passages from the lower carrier body 106 can be linked to passages in the upper carrier body 104 by flexible tubing that extends inside the loading chamber 110 or outside the carrier head 100. Pressurization of each chamber can be independently controlled. In particular, pressurization of each chamber 650 can be independently controlled. This permits different pressures to be applied to different radial regions of the substrate 10 during polishing, thereby compensating for non-uniform polishing rates.

The membrane assembly 500 can include a membrane support 716, an outer membrane 700, and an inner membrane 600. The outer membrane 700 has an inner surface 702 that can be positioned to contact the inner membrane 600, and an outer surface 704 that can provide a mounting surface for the substrate 10. A flap 734 of the outer membrane 700 can have a lip 714 secured to the membrane support 716, and clamped between the membrane support 716 and a clamp 736. The clamp 736 can be secured to the lower carrier body 106 by a fastener, screw, bolt, or other similar fastener. The flap 734 can separate the lower pressurizable chamber 722 and the chamber 724. The lower pressurizable chamber 722 is configured to extend across the bottom of the inner membrane 600 and the sides of the inner membrane 600. The inner membrane 600 is positioned between the lower pressurizable chamber 722 and the membrane support 716. The upper pressurizable chamber 726 is formed by the membrane assembly 500 (including the membrane support 716) and the lower carrier body 106. The upper pressurizable chamber 726 is sealed from a chamber 728 (which can vent to the outside of the carrier head 100) above the flexure 900 by the flexure 900.

The outer membrane 700 can apply a downward pressure on a majority or the entirety of the substrate 10. The pressure in the lower pressurizable chamber 722 can be controlled to allow the outer surface 704 of the outer membrane 700 to apply pressure to the substrate 10.

Optionally, the inner membrane 600 can define a plurality of individually pressurizable chambers 650 that can vertically move relative to one another (i.e., via a flexure 656 of the inner membrane 600 above a gap 655 located between the individually pressurizable chambers 650 that allow each individually pressurizable chamber 650 to vertically move relative to another individually pressurizable chamber 650). The lips 652 of the inner membrane 600 are configured to be secured to the membrane support 716 using clamps 660. The clamps 660 can be secured to the membrane support 716 by a fastener, screw, bolt, or other similar fastener. Each inner chamber 650 can individually apply a downward pressure on a corresponding portion of the inner membrane 600, which can then apply a downward pressure on a corresponding portion of the outer membrane 700, which can then apply downward pressure on a corresponding portion of the substrate 10.

In some implementations, instead of having the inner membrane 600 and the outer membrane 700, the membrane assembly 500 can have a single membrane secured to the membrane support 716.

Referring to FIGS. 1A and 1B, the lower carrier body 106 can be connected to the membrane assembly 500 using a flexure 900. The flexure 900 can be connected to the housing 102 (e.g., the lower carrier body 106) and the membrane assembly 500 using fasteners 902, e.g., adhesive, screw, bolt, clamp, or by interlocking, to name a few examples.

The flexure 900 can be composed of a flexible material such as a rubber, e.g., silicone rubber, ethylene propylene diene terpolymer (EPDM), or a fluoroelestomer, or a plastic film, e.g., polyethylene terephthalate (PET) or polyoxymethylene. The flexure 900 can sufficiently stiff to resist lateral motion so as to keep the membrane assembly 500 centered below the housing 102. However, the flexure 900 can be sufficiently vertically flexible to permit vertical motion of the membrane assembly 500 relative to the housing 102.

The flexure 900 can permit the membrane assembly 500 to vertically move relative to the lower carrier body 106 by permitting the flexure 900 to flex, e.g., bendably deflect. As the flexure 900 flexes, the pressure applied by the flexure 900 to the membrane support 716, and thus the substrate 10, can increase or decrease.

A controller 910 can be used to regulate the pressure of the various chambers of the carrier head 100. The controller 910 can be coupled to a plurality of pressure sources 922 (although one pressure source 922 is illustrated, but there can be a plurality of pressure sources 922), a pressure source 924, and a pressure source 926. The pressure sources 922, 924, 926 can be, for example, a pump, a facilities gas line and controllable valve, etc. Each pressure source 922 can be connected to an individually pressurizable inner chamber 650, the pressure source 924 can be connected to the lower pressurizable chamber 722, and the pressure source 926 can be connected to the upper pressurizable chamber 726.

A sensor 930 can measure the pressure(s) in the pressure sources 922, 924, 926, the individually pressurizable inner chambers 650, the lower pressurizable chamber 722, and the upper pressurizable chamber 726. The sensor 930 can communicate the measured pressure(s) to the controller 910. The controller 910 can cause the pressure sources 922, 924, 926 to increase and/or decrease the pressure in the individually pressurizable inner chambers 650, the lower pressurizable chamber 722, and/or the upper pressurizable chamber 726.

As the carrier head 100 performs polishing operations, the retaining ring 205 and/or the outer ring 400 can wear down. As the retaining ring 205 and/or the outer ring 400 wear down, the flexure 900 flexes to apply an increased downward pressure on the membrane support 716, and thus the substrate 10, resulting in an increased polishing rate of the substrate 10.

Referring to FIGS. 1A and 1B, to compensate for wear of the retaining ring 205 and/or the retaining ring 400 resulting in increased load (i.e., applied pressure) on the substrate 10, the pressure in the upper pressurizable chamber 726 can be adjusted to maintain a consistent total load on the substrate 10.

To determine the requisite change in pressure, a sensor 950 can measure the distance of a change in distance from the sensor 950 to a target 954, and the controller 910 can detect the change in the distance based on the signal from the sensor 950. The sensor 950 can be a radar, laser, optical, ultrasonic, or other similar proximity sensor.

The sensor 950 can be secured in the carrier head 100, e.g., located in the lower carrier body 106. The sensor 950 is positioned to measure a distance between the sensor 950 and the target 954. For example, the target 954 can be a portion of the top surface of the membrane assembly (e.g., the top surface of the membrane support 716) below the sensor 950.

Figure 2:
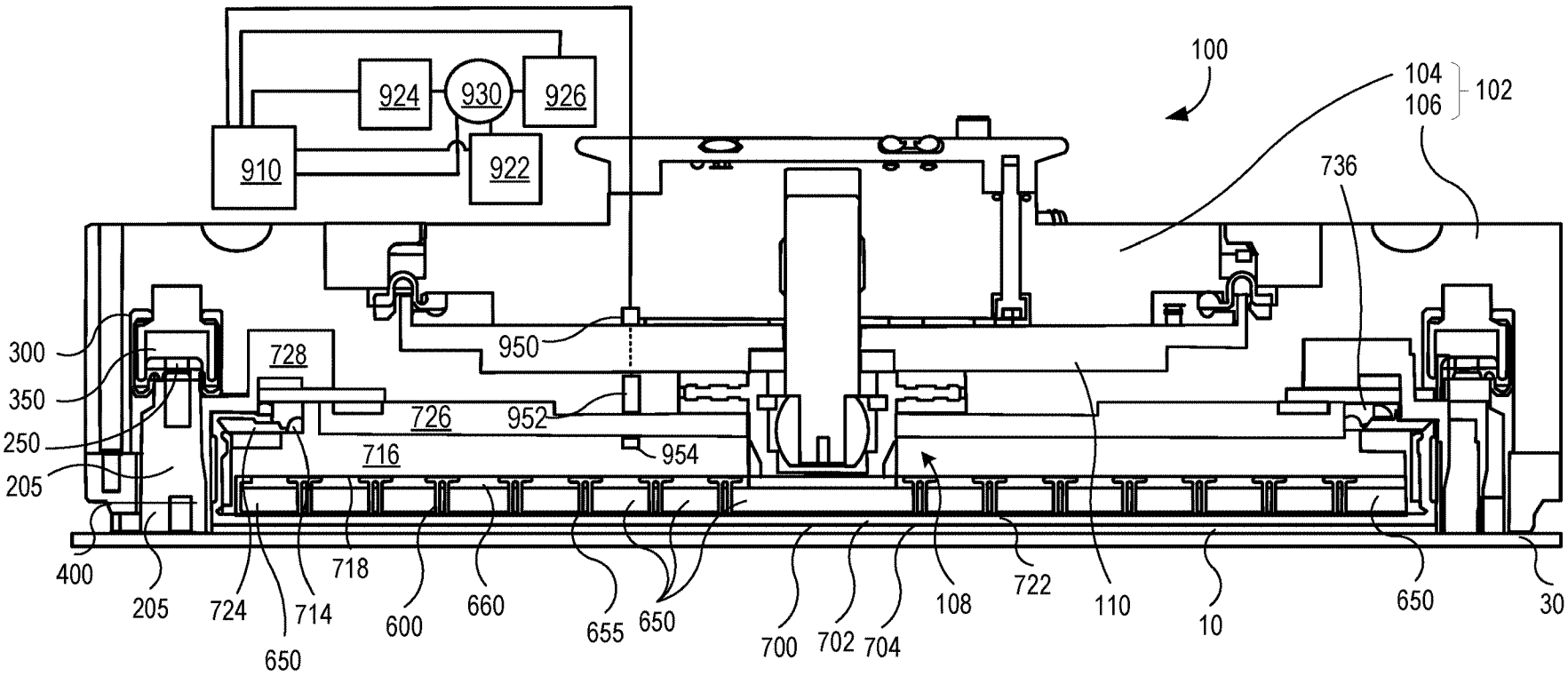
FIG. 2 is a schematic cross-sectional view of another implementation of a carrier head.

Referring to FIG. 2, in some implementations, the sensor 950 can be secured to the upper carrier body 104. A window 952 can be located between the sensor 950 and the target 954, passing through the lower carrier body 106. The window can permit the sensor 950 to measure the distance between the sensor 950 and the target 954, without affecting the pressure of the various chambers, e.g., the loading chamber 110 or the upper pressurizable chamber 726. The chamber 110 can be depressurized to draw the lower carrier body 106 upward against the upper carrier body 104 before performing the measurement of the distance with the sensor 950. This can ensure that separation between the lower and upper carrier bodies does not contribute to variability of the measured distance.

Further, the sensor 950 can be connected to the controller 910, and can report the measured distance or change in measured distance (e.g., a decreased distance due to wear of the retaining ring 205 and/or the retaining ring 400) to the controller 910. The controller 910 can in turn cause the pressure source 926 to decrease the pressure in the upper pressurizable chamber 726 to maintain the load on the substrate 10.

The controller 910 can be configured to adjust the pressure of the upper pressurizable chamber 726 based on the measured distance between the sensor 950 and the target 954. That is, the controller 910 can be configured such that, as the flexure 900 flexes and decreases the distance between the sensor 950 and the target 954, thereby increasing the pressure applied by the flexure 900 to the substrate 10, the controller decreases the pressure of the upper pressurizable chamber 726 to compensate for the increased pressure applied by the flexure 900.

The pressure of the upper pressurizable chamber 726 can be a function of the measured distance between the sensor 950 and the target 954. For example, as the measured distance between the sensor 950 and the target 954 decreases, the pressure of the upper pressurizable chamber 726 can decrease. The controller 910 can receive the intended pressure, e.g., from a polishing recipe represented by data stored in a non-transitory computer readable medium, and the measurement of the distance from the sensor 950. The controller calculates a revised pressure for the upper pressurizable chamber 726 based on intended pressure and the distance measurement. The amount to decrease the pressure in the upper pressurizable chamber 726 can be stored in a look-up table that correlates the change in pressure to the distance. The change in pressure can be a non-linear function of the distance, and can depend on the flexure design. In addition, the change in pressure can be stored in the look-up table as an absolute pressure change or a percentage change relative to the intended pressure. This change is applied, e.g., by subtraction or multiplication as necessary based on the type of change, to the intended pressure to calculate the revised pressure.

To determine the functional relationship between the distance and the pressure difference, a sequence of pairs of measurements of distance and total down pressure from the membrane assembly 500 can be made using retaining rings with different amounts of wear. In particular, the retaining ring can be installed on the carrier head, the carrier head is positioned over a pressure sensor, e.g., a pressure sensor pad, and the upper pressurizable chamber 726 is brought to a consistent pressure for each pair of measurement. Then the distance is measured by the sensor 950, and the total applied pressure from the membrane assembly 500 is measured by another sensor, e.g., the pressure sensor pad. The plurality of pairs of measurements can provide the increase in applied pressure as a function of the distance measurement; a pressure offset for the upper pressurizable chamber 726 to bring the total applied pressure back to a consistent pressure can be calculated as a function of the measured distance from this data.

The controller and other computing devices part of systems described herein can be implemented in digital electronic circuitry, or in computer software, firmware, or hardware. For example, the controller can include a processor to execute a computer program as stored in a computer program product, e.g., in a non-transitory machine readable storage medium. Such a computer program (also known as a program, software, software application, or code) can be written in any form of programming language, including compiled or interpreted languages, and it can be deployed in any form, including as a standalone program or as a module, component, subroutine, or other unit suitable for use in a computing environment.

In context of the controller, "configured" indicates that the controller has the necessary hardware, firmware or software or combination to perform the desired function when in operation (as opposed to simply being programmable to perform the desire function).

While this document contains many specific implementation details, these should not be construed as limitations on the scope of any inventions or of what may be claimed, but rather as descriptions of features specific to particular embodiments of particular inventions. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

A number of embodiments of the invention have been described. Nevertheless, it will be understood that various modifications may be made without departing from the spirit and scope of the invention. Accordingly, other implementations are within the scope of the following claims.

What is claimed is:

1. A carrier head for chemical mechanical polishing, comprising:

a housing for attachment to a drive shaft;

a membrane assembly beneath and vertically movable relative to the housing, wherein the membrane assembly includes a membrane support and a flexible membrane secured to and suspended from the membrane support, wherein a volume between the housing and the membrane assembly above the membrane support provides a pressurizable first chamber, and wherein the flexible membrane defines a pressurizable second chamber below the membrane support; and a sensor in the housing configured to measure a distance from the sensor to the membrane support of the membrane assembly; and a controller configured to receive a distance measurement from the sensor and to control a pressure source to pressurize the pressurizable first chamber based on the distance measurement, and decrease pressure in the pressurizable first chamber as the distance measurement decreases.

2. The carrier head of claim 1, comprising a flexure that connects the membrane support to the housing.

3. The carrier head of claim 2, wherein the flexure is sufficiently stiff to center the membrane assembly within the housing.

4. The carrier head of claim 2, wherein the flexure seals the pressurizable first chamber.

5. The carrier head of claim 1, wherein the housing comprises an upper carrier body that is vertically fixed relative to the drive shaft and a lower carrier body that is vertically movable relative to the upper carrier body, and wherein the membrane support is mechanically coupled to the lower carrier body.

6. The carrier head of claim 5, wherein the sensor is mounted on the upper carrier body.

7. The carrier head of claim 6, comprising a window through the lower carrier body between a target and the sensor.

8. The carrier head of claim 1, wherein the sensor is a radar, laser, or ultrasonic sensor.

9. The carrier head of claim 1, further comprising a target on the membrane support below the sensor.

10. The carrier head of claim 1, further comprising a retaining ring connected to the housing.

11. The carrier head of claim 2, wherein the controller is configured to maintain a consistent total downforce on the membrane assembly as the distance between the sensor and the membrane support changes.

12. The carrier head of claim 11, wherein the controller is configured to compensate for changes in load on the membrane assembly from the flexure.

* * * * *